United States Patent [19]

Geiger

[11] Patent Number: 4,949,477

[45] Date of Patent: Aug. 21, 1990

[54] CONTROL SYSTEM WITH VALVE FLAPS FOR A DRIER

[75] Inventor: Friedrich Geiger, Heilbronn, Fed. Rep. of Germany

[73] Assignee: Passat Maschinenbau GmbH, Fed. Rep. of Germany

[21] Appl. No.: 360,084

[22] Filed: Jun. 1, 1989

[30] Foreign Application Priority Data

Jun. 8, 1988 [DE] Fed. Rep. of Germany ..... 3819514

[51] Int. Cl.[5] ..... F26B 11/02

[52] U.S. Cl. ..... 34/133; 34/140

[58] Field of Search ..... 34/133, 131, 77, 60, 34/139; 432/1

[56] References Cited

U.S. PATENT DOCUMENTS

| | | | |
|---|---|---|---|
| 3,190,011 | 6/1965 | Shields | 34/133 X |
| 3,831,294 | 8/1974 | Freze | 34/133 X |
| 4,268,247 | 5/1981 | Freze | 432/21 |

*Primary Examiner*—Henry A. Bennet

*Attorney, Agent, or Firm*—Roylance, Abrams, Berdo & Goodman

[57] ABSTRACT

For controlling the quantities of supply, waste and recycled air which can be transported by means of a blower (36) for the drying process in a drier (10), this latter comprises a cohesive valve space (38) in which two valve flaps (40 and 42) can be pivoted by a drive. According to the position which the two valve flaps occupy, so the quantities of air supplied and carried away through the apertures (54, 62, 70, 74, 76, 80) in the valve chamber (38) for the drying process are controlled. A third valve flap (44) which can be triggered by a drive controls the process of blowing the washing out of the drier drum (16) after drying. For the sound and heat insulation of the drier (10), a housing (150) in two halves (152 and 154) which covers the blower (36) and the heat exchanger (34) is provided over the valve space.

19 Claims, 7 Drawing Sheets

22
132
34
138
69
20
16
136
52
115
130
141
64
162
38
96
66
62
48
42
166
112
72
126
128
124
76
140
80a
71
131
134
80
70
68
74
69
44
92
53
56
69
94
88
58
160
50
60
102
164
75
40
54
36
10

CONTROL SYSTEM WITH VALVE FLAPS FOR A DRIER

The invention relates to a drier, particularly for washing, with a control system with valve flaps for controlling the quantities of supply, waste and circulating air transported by a blower for the drying process in a drier drum.

A control system with valve flaps purely for the quantities of waste air from a drier is known from DE-OS 36 00 059. Also, driers are known which have such control systems that certainly for controlling the individual quantities of air the valve flaps are disposed at various locations on the drier, which means that such driers are of correspondingly large construction.

In the case of such driers, the invention is based on the problem of achieving a smaller overall size, in other words smaller dimensions.

According to the invention, this problem is resolved in that the control system comprises a cohesive valve space which is subdivided by a partition into a first and a second partial valve space, at least the first partial valve space consisting of a valve chamber which is substantially closed in respect of the environment and which has at least one blow-in aperture connected to the outlet of the blower, which is connected by its induction side to the drum interior, and which has at least one waste air orifice which connects the valve space to the outside environment, the second partial valve space comprising at least one inlet aperture which connects the interior of the drum to the outside environment and, for opening and closing the inlet aperture and blow-in aperture, having at least one first and one second valve flap which can be moved by at least one triggerable drive into at least one open position and one closed position and further in that, in one of its open positions, the first valve flap opens up at least the flow path from the blow-in aperture to the drum interior or, in its closed position, to the waste air orifice, while the second valve flap, in one of its open positions, opens up the flow path from the outside environment through the inlet aperture to the drum interior or alternatively and when in its closed position closes this path again and in that a heat exchanger is disposed at least between the inlet aperture and the drum interior.

Thus, the entire control system for controlling the quantities of air to be transported are grouped together in one valve space into which discharge all the air guide ducts so that from there, valve flaps are able to control the drying process centrally, in other words from one location. By this controlled grouping of the control parts at one location, such a control system is very small and therefore also reduces the overall size of the drier.

In the case of a preferred embodiment, the first valve flap with its open position diminishing as far as its closed position, divides off an increasing proportion of the flow quantity which can be blown through the blow-in aperture by the blower, so that it emerges from the waste air orifice. In the case of such driers, the dry air required is heated by a heat exchange which serves as a heating unit and is drawn through the drum by the blower. This produces a negative pressure in the drum interior which is intended to assist the evaporation of the water from the washing. If, now, for any reason whatsoever, the pressure in the drier drum rises, for example because the washing to be dried in the drier drum starts to acquire a greater volume in the drum during the drying process and thus forces air out of the drier drum so that by corresponding actuation of the first valve flap in the direction of its closed position, as a function of the increase in pressure, the flow quantity which produces the pressure rise is delivered to the waste air orifice so that the negative pressure inside the drier can be maintained.

In the case of a particularly preferred embodiment, the first valve flap, in each of its positions, exposes an aperture in the partition which connects the drum interior via the first chamber and the intake aperture of the second valve chamber to the environment when the second valve flap is in one of its open positions. Thus, by utilizing the Bernoulli effect, while the blower is running, ambient air is able to flow through the intake aperture of the second valve chamber and the opening in the partition into the partial space in the first valve chamber which is bounded by the first valve flap with its underside which is towards the drum interior when the two valve flaps have assumed one of their open positions.

In the case of a particularly preferred embodiment, the heat exchanger is disposed over the entire periphery of the in-flow apertures which can be opened up by the first and second valve flap in one of their open positions, towards the drum interior. Consequently, when the second valve flap is in one of its open positions, the ambient air can be passed through the intake aperture and the aperture in the partition also via the first valve chamber and via the part of the heat exchanger situated underneath it and into the drum interior so that when the blower is operating for the incoming air from the outside environment, a greater heating area of the heat exchanger which serves as the heating medium is available so ensuring a greater degree of efficiency and thus, for a comparable drier output compared with prior art driers, it is possible to use a heat exchanger of smaller overall size which in turn makes it possible to reduce the overall size of the drier.

In the case of a further preferred embodiment, the drive moves the two valve flaps in opposite directions during their pivoting movements when opening and closing. This makes for an accurate control of quantity in the proportion of fresh air supplied from the outside environment and circulating air recycled inside the drier by the blower. Because according to the position assumed by the independently controllable valve flaps, so the quantities of supplied fresh air and recycled air, and also waste air, will vary.

In the case of a particularly preferred embodiment, the drive jointly triggers the first and second valve flaps. This produces a positive coupling of the valve flaps which are adapted to move in operation to each other, so largely excluding the possibility of a malfunction of the control system.

In the case of a further preferred embodiment, for opening and closing the waste air orifice, a third valve flap is provided which can be triggered by a drive.

This makes it possible to control the quantity of waste air emerging through the waste air orifice into the free air.

In the closed or open position of the third valve flap, this latter exposes or closes a blow-out orifice. The blow-out orifice is, for blowing the washing out of the drum after the drying process, constantly connected to the front of the drier drum which is open towards the loading side by at least one duct. In consequence, the quantity of flow directed at the waste air orifice, via the blow-out orifice, is used for blowing the washing out of the drier drum when the drying process is completed.

In the case of a preferred embodiment, the second partial valve space is a second valve chamber corresponding substantially to the first valve chamber and forming a part of the duct which serves for blowing out the washing and which, regardless of the valve position of the second valve flap, is shut off in respect of the environment by a shut-off member which is rigidly connected to this valve flap. The result is a particularly expedient and simple as well as stylistically attractive construction of the valve chamber as a whole and a particularly expedient guidance of the blow-out flow from the first valve chamber to the drum interior.

In the case of a further preferred embodiment, for sound and heat insulation, the blower, the two valve chambers and the heat exchanger are enclosed by a housing having a constant opening which connects the outside environment with the drum interior. In consequence, while the blower is operating, a part of the fresh air available in the ambient is constantly being drawn into the drum interior by the negative pressure which prevails there and which is sufficient to prevent the progation of sound and thus the creation of noise and which draws the heat created in this housing which serves as an energy collecting canopy continuously into the drum interior for the drying process.

In the case of a preferred embodiment of the drier according to the invention, at least one of the two valve flaps and preferably the first valve flap is so disposed that in each of the flap positions which it is adapted to assume, at least a part of its total surface is substantially parallel with the direction of incident flow. In this case, where the first valve flap is concerned, the direction of incident flow is established by the quantity of flow from the blower which is passed into the valve space through the inlet aperture. Where the second valve flap is concerned, it is the flow quantity which flows out of the environment through the intake aperture and into the interior of the valve space. Consequently, a substantially lamina guidance of the flow quantities at the valve flaps is achieved, ensuring that without the creation of turbulence in the valve chamber the flow quantities are passed to the envisaged locations in the drier. Thus, pivoting of the valve flaps is possible with minimal application of force, safeguarding the drive mechanism of the valve flaps and making it possible to use low-output drives.

In the case of a further preferred embodiment, at least the first and the second valve flaps are so disposed that in the direction of incident flow of these valve flaps, in each of the flap positions which they are adapted to assume, they offer to the flow only a minimal effective area of resistance of their total surface, preferably their end faces which are directed at the incident flow. In comparison with a prior art arrangement of valve flaps in which the flow quantities strike the total surface of the relevant valve flap which acts as a resistance surface in a substantially perpendicular direction, this has the advantage that only relatively minimal forces are required in order, against the air resistance created by the flow quantities, to pivot the relevant valve flap into one of the positions which it is capable of assuming. By reason of the fact that the end faces of the two valve flaps face the direction of incident flow in any of their flap positions, a very accurate subdivision of flows is possible which then, according to the operating condition of the drier, can be passed on to the relevant areas, for example the interior of the drier or the environment, as the case may be. Thus, a very accurate control of the quantities of fresh air, recycled air or waste air can be achieved.

In the case of a further preferred embodiment of the drier, at least the first valve flap is in the form of an aircraft wing, and it is in particular constructed with an upwardly-extending curvature. As a result of this construction like an aircraft wing, the flow which passes over the valve flap is accelerated in its velocity in relation to the flow which passes underneath the valve flap so that as with an aircraft wing, lift forces occur at the valve flap which becomes greater as the flow velocity increases. In consequence, it is also possible to relieve the drive for lifting the valve flap which is so constructed, so that it can be pivoted.

The invention is explained in detail with reference to an example of embodiment described in greater detail hereinafter and illustrated although in diagrammatically simplified form in the accompanying drawings, in which.

Figure 1:
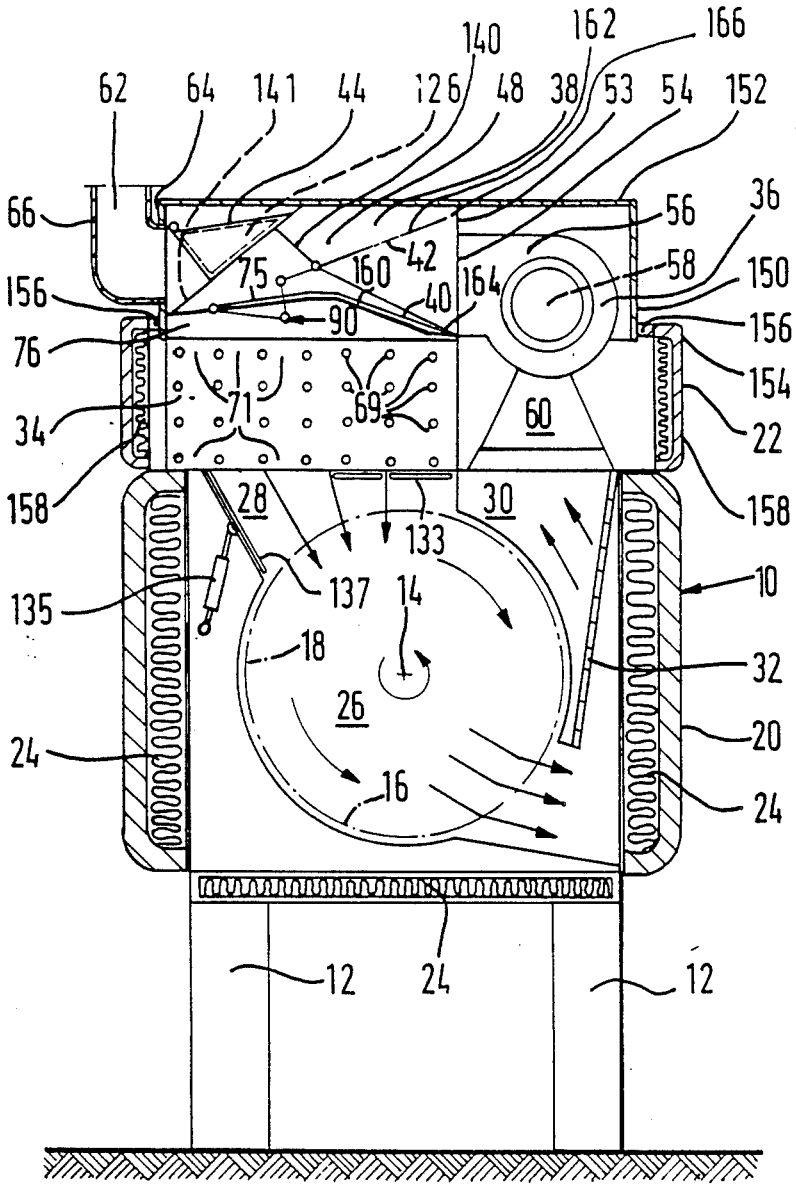
FIG. 1 is an end elevation of the back (unloading side) of the drier viewed in the axial direction of the drier drum.

FIG. 1 shows a drier generally designated 10 and standing on legs 12. Disposed in the housing 10 is a drier drum 16 adapted to rotate about an axis 14. For the passage of air and/or water vapour, the drier drum 16 comprises in a known manner, and not shown in greater detail therefore, apertures on its outer periphery 18. For reasons of simplicity, mention will be made hereinafter purely of the air transport. This implies however that also water vapour, where it occurs, can correspondingly be transported by the arrangements. The drier 10 is substantially subdivided into a bottom part 20 and a top part 22. The bottom part 20 of the drier 10 is, for sound and heat insulation, enclosed in an insulating jacket 24. The drier drum 16 is disposed in the interior 26 of the drier which can be connected by passages 28 and 30 for the inlet and outlet of air to the upper part 22 off the drier 10. Between the interior 26 of the drier 10 and the passage 30 for the outlet of air, a fluff filter 32 is provided.

The top part 22 of the drier 10 consists essentially of a heat exchanger 34 which serves as a heating element, a blower 36 and a valve space 38 with three valve flaps 40, 42 and 44.

Figure 2:
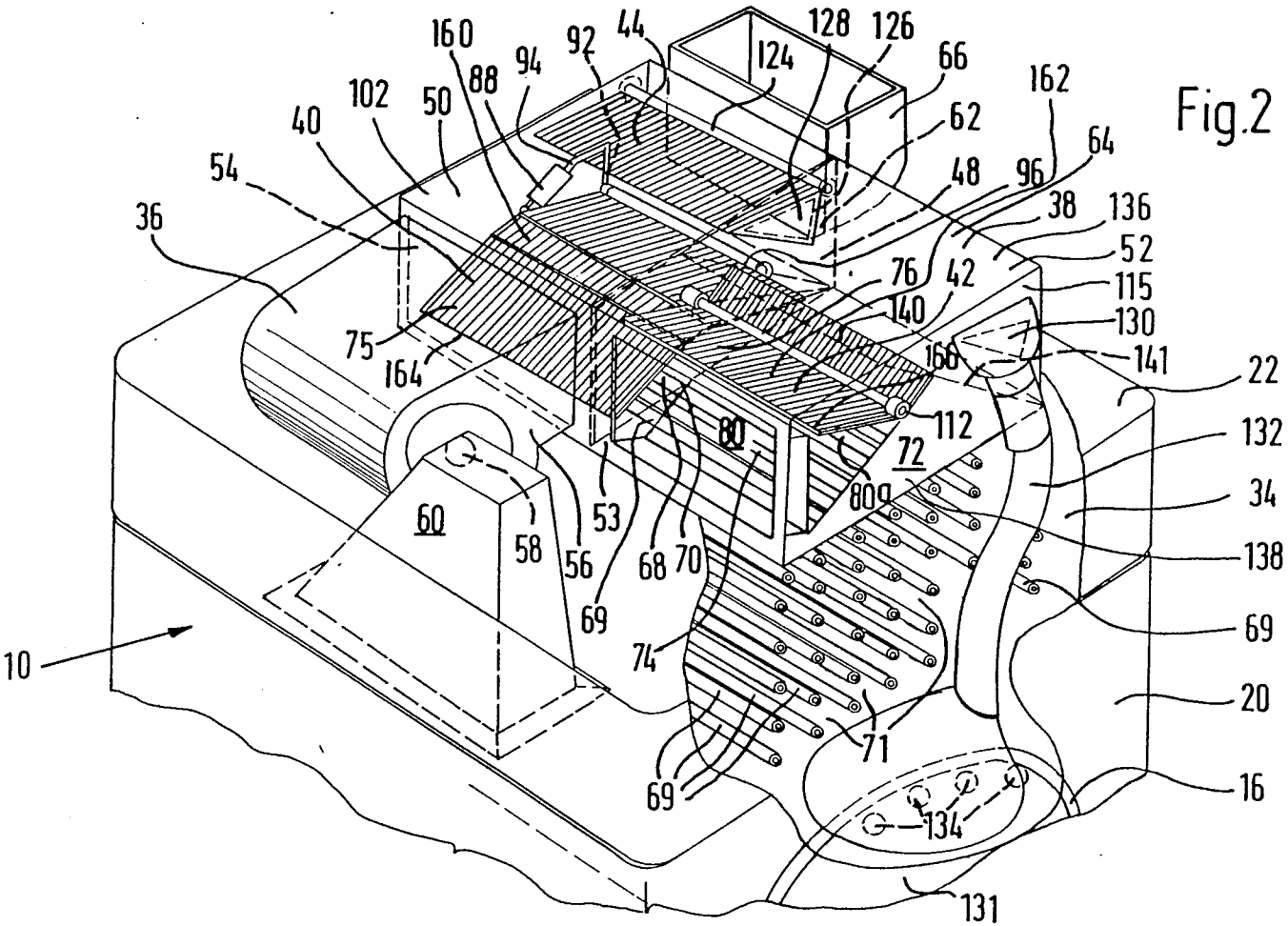
FIG. 2 is a perspective sketch showing the part of the drier which is disposed above the drier drum, viewed from the front (washing loading side) and without a covering, through the blower.

As the perspective view in FIG. 2 shows, the valve space 38 consists of two cohesive valve chambers 50 and 52 which are subdivided by a partition 48. The valve space 38 is thereby substantially a parallelepiped box composed of rectangular sheet metal blanks, the box being placed on the heat exchanger 34, its five outer sides sealing off the interior of the valve chambers 50, 52 in respect of the outside ambient. The first valve chamber 50 has at the front 53 of the valve space 38 which is towards the blower 36 an inlet aperture 54 which is connected to the outlet 56 of the blower 36. The blower 36 is in turn connected by a shaft 60 (FIG. 1) through its air-inducting side 58 to the passage 30 provided for the outlet of air, and thus with the interior 26 of the drier 10. On the side of the first valve chamber 50 which is opposite the inlet aperture 54, a waste air orifice 62 is provided in the back wall 64 of the valve space 38. This waste air orifice 62 leads through a chimney 66 into the free air (outside ambient or environment). The underside 68 of the first valve chamber 50 which is towards the heat exchanger 34 forms a first inlet aperture 70 which discharges into the air inlet passages 71 of the heat exchanger 34 which are divided off by the heating bars 69 and which in turn discharge into the air inlet passage 28 so that a constant air-permeable connection is possible between the first valve chamber 50 and the interior 26 of the drier 10.

The second valve chamber 52 which substantially corresponds to the first valve chamber 50 in terms of chamber volume has on its side which is towards the lower outlet 56 from the blower 36 an intake aperture 80 in the front 53 of the valve space 38 which substantially corresponds in cross-section to the intake aperture 54. The intake aperture 80 for the fresh air supply leads into the open (outside environment). This intake aperture 80 can be enlarged in cross-section if a triangular cut-out **80*a* is provided in the outside wall 115 of the second valve chamber 52 which is towards the loading side of the machine and if it can be masked by the second valve flap 42. The underside 72 of the second valve chamber 52 which is towards the heat exchanger 34 forms a second in-flow aperture 74 comparable with the first in-flow aperture 70 and which, like this latter, is connected to the interior 26 of the drier 10**.

Both in-flow apertures 70 and 74 communicate with each other. For this purpose, the partition 48 has in its bottom part which is towards the heat exchanger 34 an aperture extending over its entire length. For opening and closing the two in-flow apertures 70 and 74, there are in the two valve chambers 50 and 52 two valve flaps 40, 42 which are adapted to pivot about in each case a shaft 96, 112 which extends substantially parallel with the drum axis 16. The first valve flap 40 disposed to pivot in the first valve chamber 50, when in its closed position 75 shown in FIG. 2, closes the first in-flow aperture 70 from above and completely opens the way from the blow-in aperture 54 to the waste air orifice 62. In the fully-opened position of the first valve flap 40 (FIG. 4), the way between the first in-flow aperture 70 and the inlet aperture 54 for blowing in air from the blower 36 is completely opened and the way between the blow-in aperture 54 and the waste air orifice 62 is blocked. As the open position of the first valve flap 40 diminishes until it reaches its closed position, so an increasing part of the quantity of air which can be passed by the blower 34 through the blow-in aperture 54 is divided off to emerge through the waste air orifice 62. The first valve flap 40 has an upwardly curved form and its underside which is towards the interior 26 of the drier 10, in each of its assumed positions, also in its closed position 75, exposes the already-described aperture 76 in the partition 48.

Figure 3:
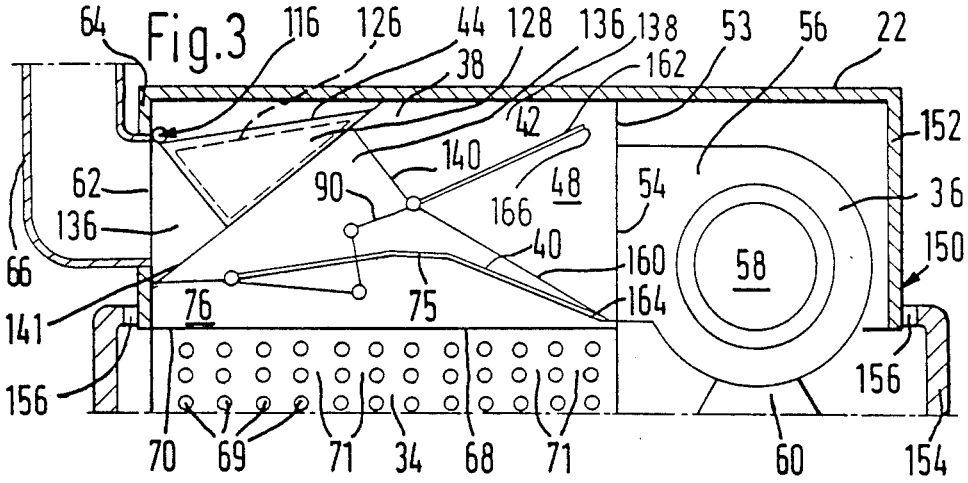
FIGS. 3 to 5 are a view corresponding to FIG. 1 but showing the upper part of the drier in various operating positions.
Figure 4:
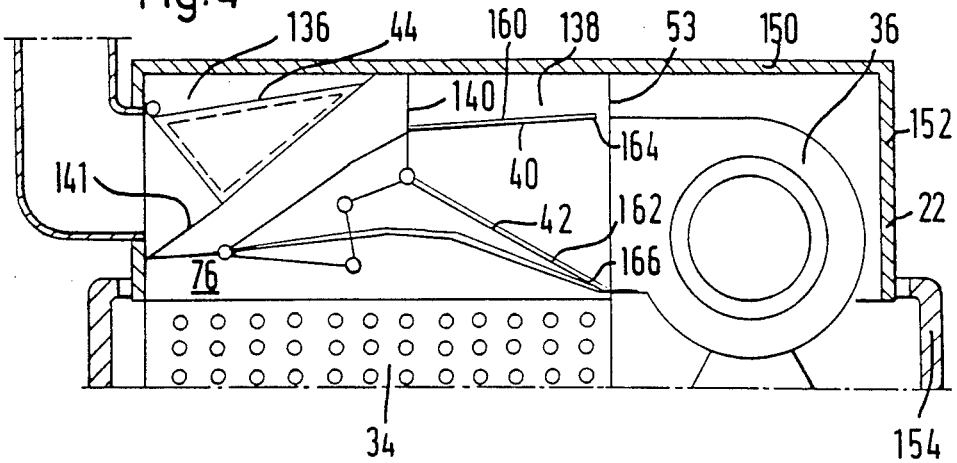

The second valve flap 42 which is pivotally disposed in the second valve chamber 52, when in the closed position 77 shown in FIG. 4, closes off the second in-flow aperture 74 from above and so shuts off the supply of fresh air through the inlet aperture 80 into the interior 26 of the drum 10. When the second valve flap 42 is in one of its open positions (FIGS. 2, 3 and 5), it opens up the way for the supply of fresh air from the inlet aperture 80 through the second in-flow aperture 74 into the interior 26 of the drum 10. Similarly, in one of its open positions, the way is opened for fresh air to pass through the intake aperture 80 and the aperture 76 in the partition 48 into the partial space of the first valve chamber 50 which is divided off by the first valve flap 40 with its underside towards the first in-flow aperture 70. The second valve flap 42 is substantially flat in construction.

Figure 7:
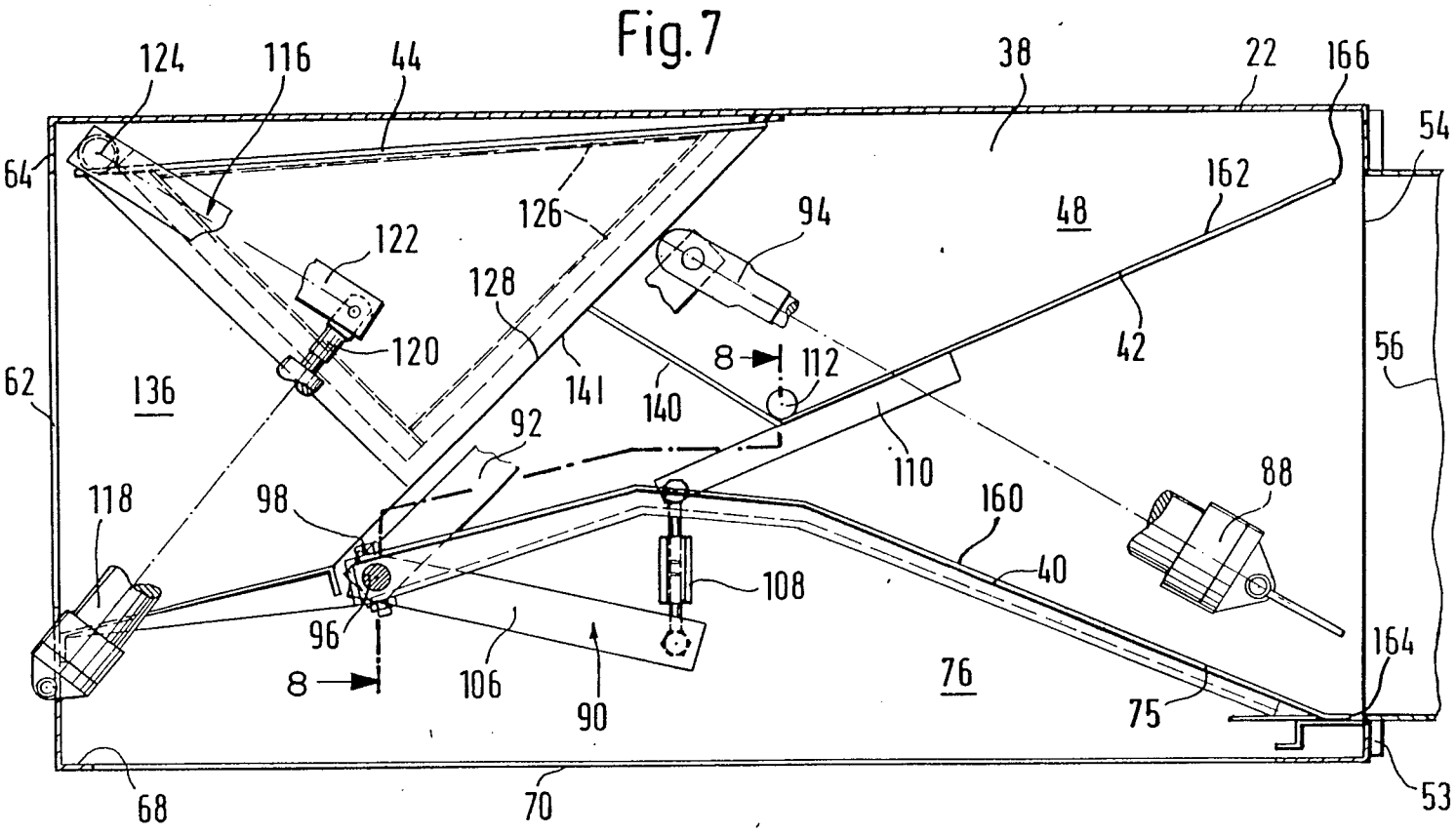
FIG. 7 is a side view of the valve chamber corresponding to FIGS. 1 and 3 to 5 with valve flaps and their drive means.
Figure 8:
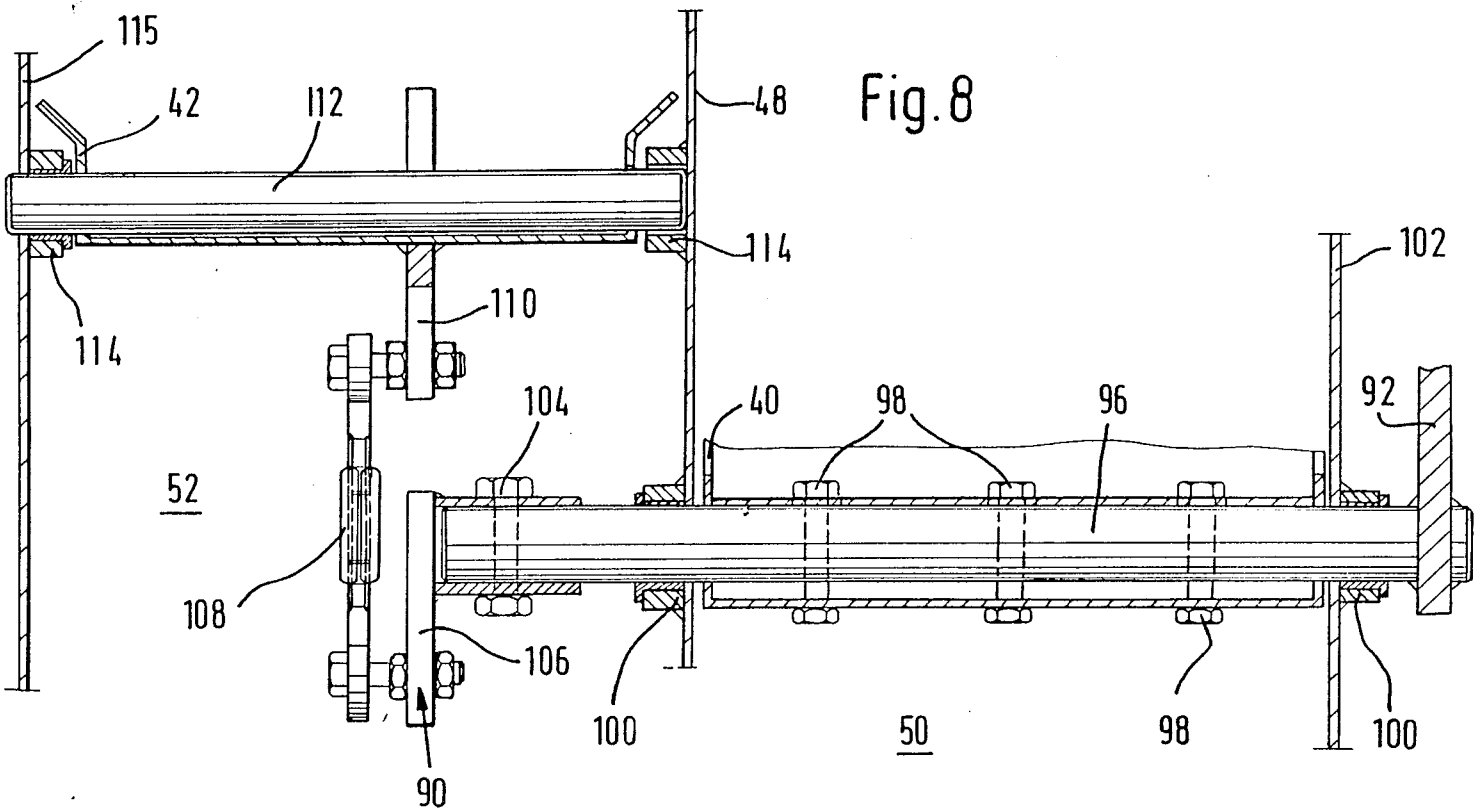
FIG. 8 shows a section taken on the line 8—8 in FIG. 7.

Hereinafter, reference will be made in greater detail to the joint drive of these two pivotable valve flaps 40, 42 (FIGS. 7, 8).

Provided as a common drive for the two valve flaps 40 and 42 is a pressure cylinder 88 which triggers the two valve flaps 40 and 42 via a linkage generally designated 90. The linkage 90 consists of a drive rod 92 one end of which is articulated on the piston rod 94 of the pressure cylinder 88 while its other end is rigidly connected to a shaft 96 (FIG. 8). Rigidly mounted on this shaft 96 by means of a screwed connection 98 is the first valve flap 40. By means of plain bearing bushes 100, the shaft 96 is guided in the outside wall 102 of the first valve chamber 50 opposite the partition 48 and in the partition 48 itself. At the other end of the shaft 96 which passes through the partition 48 and penetrates the second valve chamber 54, one end of a connecting rod 106 is rigidly connected to the shaft 96 via a further screwed connection 104. Articulated at the other end of the connecting rod 106 is a clamping screw 108 which connects the end of the connecting rod 106 to one end of a web 110 to which the second valve flap 42 is rigidly connected. The clamping screw 108 is provided for better matching of the oppositely directed movement of the two valve flaps 40, 42 to make it possible to adjust the distance between the connecting rod 106 and the web 110 accordingly. If an exact setting is made prior to operation, then instead of the clamping screw 108, it is also possible to use a fixed rod (not shown) as the connecting member. The second valve flap 42 is V-shaped and is connected to rotate about a spindle 112 mounted by plain bearing bushes 114 in the partition 48 and in the outer wall 115 of the second valve chamber 52 which is opposite the partition 48, so that it can rotate with this latter.

If, now, the cylinder 88 shown in FIG. 7 is triggered, its piston rod 94 is extended and pivots the drive rod 92 in an anticlockwise direction so that the first valve flap 40 which is rigidly connected to it is pivoted out of its closed position 75 shown in FIG. 7 into one of its open positions (FIG. 4). By this movement of the drive rod 92, the connecting rod 106 is likewise moved anticlockwise, in other words upwardly in FIG. 7, and about the shaft 96 so that the web 110 which can be pivoted about the shaft 112 via the clamping screw 108 with the connecting rod 106 is pivoted in a clockwise direction about this shaft 112. The second valve flap 42 which is rigidly connected to the web 110 is likewise moved about this shaft 112 in a clockwise direction out of its open position shown in FIG. 7 and in the direction of its closed position 77 (FIG. 4). The movement of the two valve flaps 40 and 42 in respect of each other is therefore opposite so that with an increase in the open position of the first valve flap 40, the second valve flap 42 is moved out of one of its open positions and into the direction of its closed position.

For opening and closing the waste air orifice 62, a third valve flap 44 is provided which can be separately triggered by means of a second drive. The second drive generally designated 116 comprises a pressure cylinder 118 (FIG. 7) with a piston rod 120 on which one end of a drive rod 122 is articulated, its other end engaging a shaft 124 which, like the shaft 96, is mounted in the outside wall 102 and the partition 48. Rigidly connected to this shaft 124 is the third valve flap 44 which substantially constitutes a flat plate. Cut into the partition 48 is a triangular blow-out orifice 126 which connects the first valve chamber 50 to the second valve chamber 52. On the side towards the partition 48, for covering this triangular blow-out orifice 126, the first valve flap 44 comprises, somewhat larger than the triangular opening and constructed as a plate, the triangle 128 which, in the fully-opened position of the third valve flap 44, occludes this triangular blow-out orifice 126 and, in the position in which it closes the waste air orifice 62, again shuts off this blow-out orifice 126. FIG. 7 shows the third valve flap in its fully-opened position in which it completely opens up the waste air orifice 62. By actuating the pressure cylinder 118, the piston rod 120 is retracted and the drive rod 122 is moved clockwise about the shaft 144 so that the third valve flap 44 which is rigidly connected to the shaft 124 is likewise moved clockwise in order to close the waste air orifice 62, and the triangular blow-out orifice 126 in the partition 48 is exposed.

Figure 9:
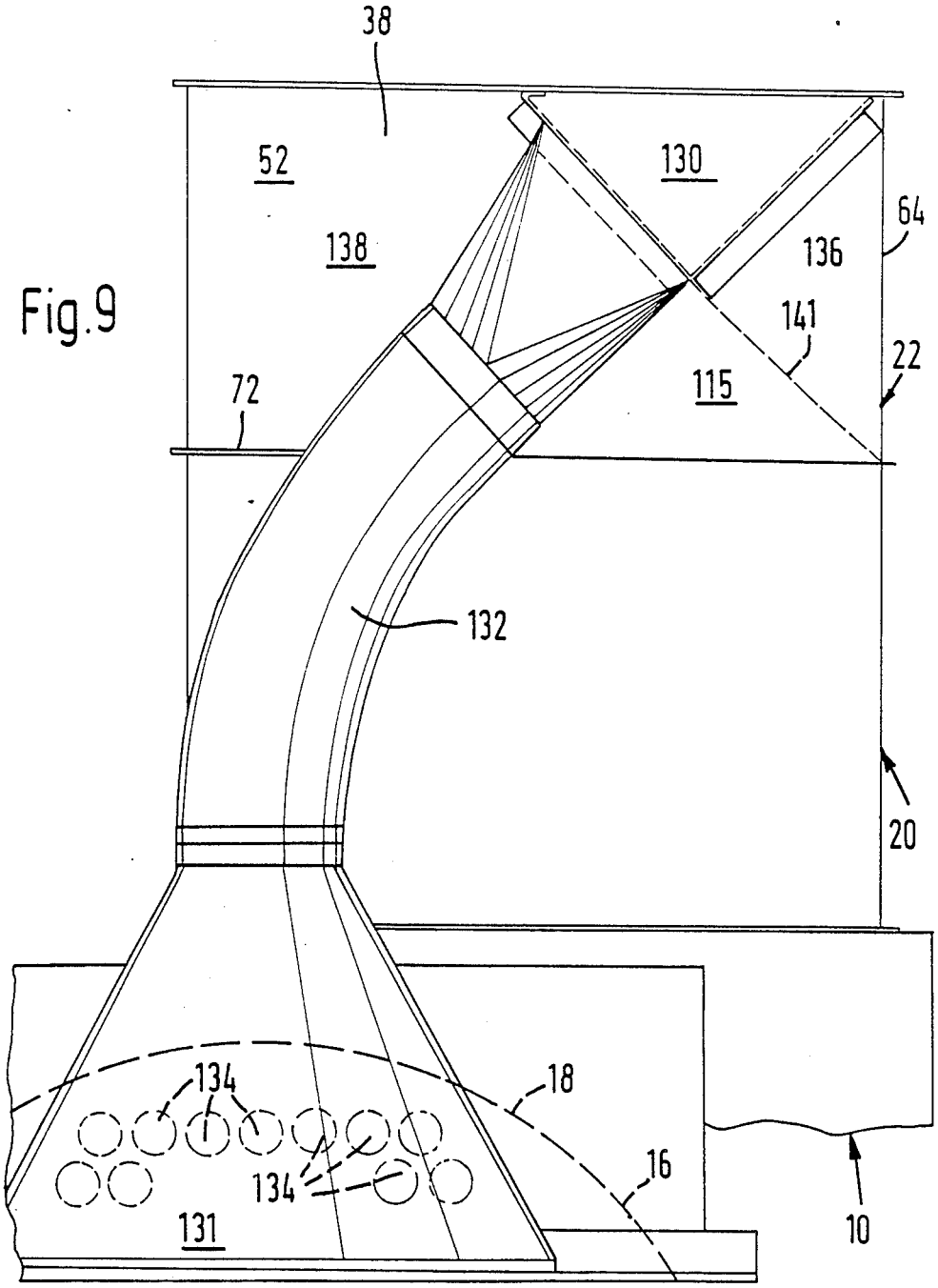
FIG. 9 is a partial end view of the front (loading side) of the drier viewed in the axial direction of the drier drum with the ducting provided there for blowing the washing out of the drier drum.

An opening 130 corresponding to the triangular blow-out orifice 126 is cut into the end wall of the inlet aperture 131 to the drum 16 in the outer wall 115 of the second valve chamber 52 (FIG. 9). Mounted on this opening 130 is the blow-out tube 132 shown in FIGS. 9 and 2 and which in a manner which is already known and which is not therefore shown in greater detail, is connected to the drum interior via in-flow apertures 134.

The connection of the two triangular apertures 126 and 130 is achieved via the rear chamber part 136 of the second valve chamber 52. The front chamber part 138 which is towards the inlet aperture 80 is isolated from the rear chamber part 136 of the second valve chamber 52 by a shut-off part 140 which is rigidly connected to the second valve flap 42 and also by the chamber wall 141 which in the meantime is completely retracted.

Figure 5:
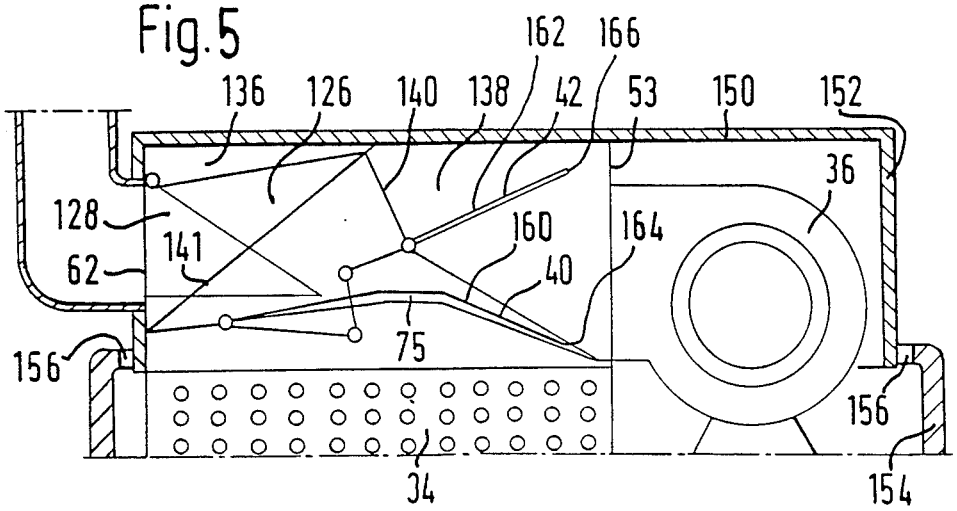
Figure 6:
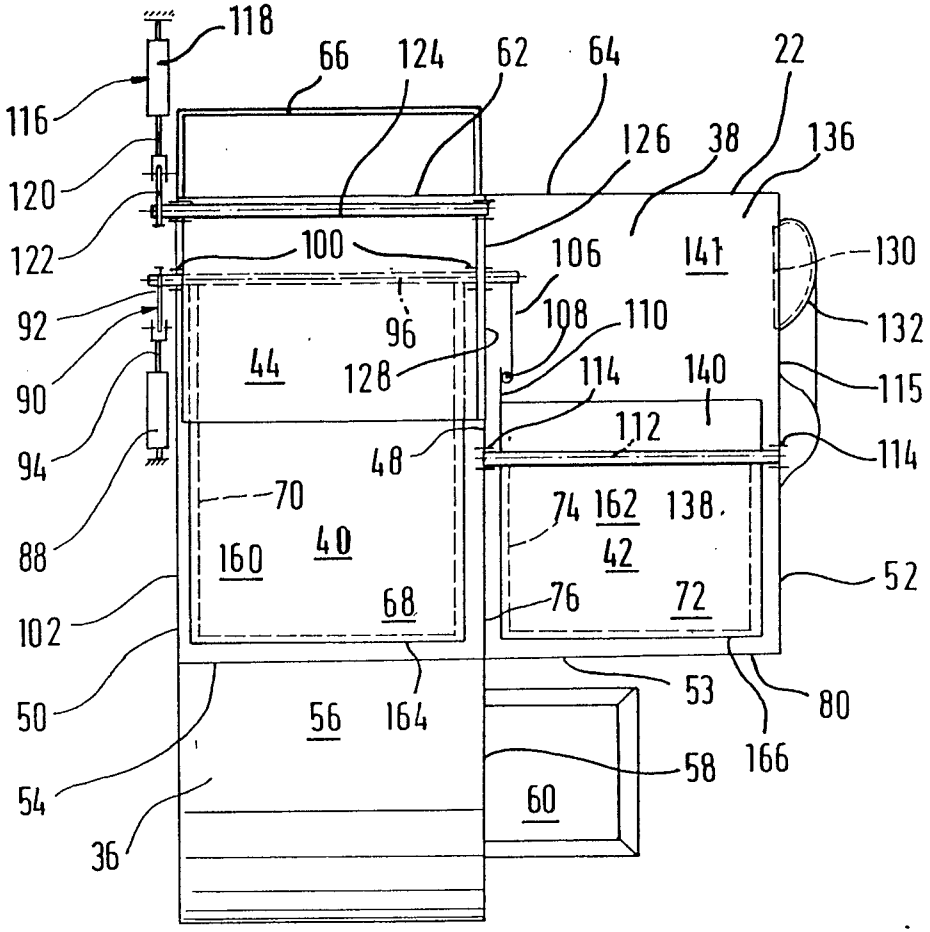
FIG. 6 is a plan view of the upper part of the drier without the covering, through the housing.

The functions of the three valve flaps 40, 42 and 44 for one drying operation will be explained hereinafter with reference to the drawings and in particular to FIGS. 3 to 5.

FIG. 3 shows the valve flap position which is usually assumed at the start of a drying process. The second valve flap 42 is fully opened and opens up the path for fresh air to enter from the environment of the drier through the inlet aperture 80 and pass to the second in-flow aperture 74 and through the aperture 76 in the partition 48 to the first in-flow aperture 70. During operation of the blower 36, the fresh air is drawn by the negative pressure generated in the interior 26 of the drier 10 by the blower 36 through the first and second in-flow apertures 70, 74 through the passages 71 via the total heatable surface of the heat exchanger 34 and the air inlet passage 28 into the drier drum 16 from which it is sucked out through the fluff filter 32, the air outlet passage 30 and the induction shaft 60 of the blower 36 and back into this latter. Thence, the air sucked in through the shaft 60 is delivered completely back into the free air through the inlet aperture 54 and the waste air orifices 62 when the first valve flap 40 is in its closed position 76. In this way, all the air sucked in through the inlet aperture 80 by the blower 36 is released again into the open air through the waste air orifice 62.

FIG. 4 shows the first valve flap 40 in its opened position and the second valve flap 42 in its closed position. When the second valve flap 42 is closed, no more fresh air can pass through the inlet aperture 80 into the interior 26 of the drier 10. Instead, the quantity of air now present in the drier is 100% recycled by means of the blower 36 when the valve flap 40 is completely opened and blocks the path to the waste air orifice 62. The flow path is thereby as follows.

Via the blow-out orifice 56 and the blow-in aperture 54, the air is transported via the first in-flow aperture 70 and the air intake ducts 71 of the heat exchanger 34 to the air inlet duct 28 and, as already described, it is passed from there through the shaft 60 back to the interior of the blower for a new recycling process.

When the two oppositely movable and positively intercoupled valve flaps 40 and 42 assume a midway position between the maximum possible open position and closed position, then the flow of air blown into the first valve chamber 50 is divided by the first valve flap 40 and according to the degree of the open position, so a part of the air is conveyed through the first in-flow aperture 70 into the interior 26 of the drier 10 while the other part is conveyed to the waste air orifice 62. When the first valve flap 40 is in such a position, the second valve flap 42 which is positively coupled to it is also in one of its open positions and thus opens up the second in-flow aperture 74. Using the Bernoulli effect, then, by means of the flow generated by the blower 36 and which passes through the first in-flow aperture 70, the fresh air supplied via the inlet aperture 80 passes through the aperture 76 in the partition 48 and, enhanced by this first in-flow aperture 70 it is drawn into the interior 26 of the drum 10 so that on the one hand, together with the proportion of the part drawn through the intake aperture 80 into the second in-flow aperture 74 and into the interior 26 of the drier 10, the entire surface of the heat exchanger is completely utilised for warming up the fresh air supplied and on the other, the in-flow of air through the intake aperture 80 is facilitated which increases the in-flow quantity of supply of fresh air into the drum interior. It is advantageous thereby if the direction of flow at the blower outlet is in the same direction as the fresh air flowing in through the inlet aperture 80, which is guaranteed by the structural design of the valve chambers 50, 52 with their apertures for the passage of air.

It is clear from what has been stated above that with the valve space 38 and the two valve flaps 40 and 42 disposed thereon, any desired quantities of fresh air can be accurately admixed with the part of the circulating air present in the system and that a waste air discharge is provided which receives the negative pressure in the interior 26 of the drier 10. Furthermore, with this arrangement according to the invention, the entire surface of the heat exchanger 34 can be used for heating the fresh air for the drying operation.

For blowing out the washing (FIG. 5), the third valve flap 44 is pivoted in front of the waste air orifice 62 by means of a separately operated drive 116 so that the flow path from the blow-in aperture 54 into the free air (ambient) is blocked. With the downwards pivoting of the third valve flap, the triangularly shaped blow-out orifice 126 is opened up. With this type of operation, the first valve flap 40 is in is closed position and the second valve flap 42 is wide open for the supply of a high proportion of fresh air. In order to avoid disturbances during this type of blowing-out, the second valve flap 42 comprises the shut-off valve 140 while the second valve chamber 52 comprises the partition 141 with which the forward chamber part 138 is separated from the rear 136 of the second valve chamber 52. As a result, no quantity of air likely to hamper the blowing-out process is able to pass via the intake aperture 80 into the rear chamber part 136. The quantity of air needed for blowing-out is then transported via the triangular blow-out orifice 126 via the rear chamber part 136 of the second valve chamber 52 to the corresponding triangular aperture 130 in the outer wall 115 and thence in a per se known manner which is therefore not described in greater detail, via the blow-out tube 132 and the in-flow apertures 134 on the loading side ofthe drier drum 16 and into this latter for unloading at the back of the drum. In this respect, an alternative arrangement is conceivable in which the blow-out tube 132 is connected directly to the triangular blow-out orifice 126. In this case, the second valve chamber 52 would become dispensable and the second valve flap 42 would not require any shut-off member 140. Then the second valve chamber 52 could be constituted by the environment. While the washing is being blown out, the underside of the heat exchanger 34 is, in a manner which is already known and which is therefore not described in greater detail, shut off by plates 133 and by a closure plate 137 which can be operated by a drive 135 (FIG. 1) in respect of the drum interior. In this way, it is possible to ensure that during blowing-out, no air can pass through the air inlet passage 218 and back into the valve chamber 38 which might hamper the blowing-out process.

For sound and heat insulating the upper part 22 of the drier 10, this latter comprises a housing 150 with an upper housing half 152 and a bottom housing half 154. The bottom housing half 154 substantially forms a box-shaped frame for the heat exchanger 34 and the shaft 60 of the blower 36. This bottom housing 154 exposes upwardly an aperture for receiving the bottom rim of the upper housing half 152 which fits onto the valve chamber 38 substantially covering this and the blower 36. With their mutually facing edges, the two housing halves 152 and 154 define a completely encircling gap 156. The purpose of this gap 156 is to ensure that air can constantly flow from the environment into the interior 26 of the drier 10 when there is a negative pressure therein. The air flowing in through the gap 156 on the one hand suppresses the emissions of sound from the blower 36 while on the other it absorbs the irradiated heat from the heat exchanger 34 and, rising due to the heat, collects in the upper housing half 152 which serves as an energy collecting canopy, whence according to the valve flap setting and the operation condition of the drier, it is continuously dissipated into the interior 26 of the drier; which reduces the heat in the drier environment. The two housing halves 152 and 154 can be provided with an insulation 158, as FIG. 1 shows in respect of the bottom housing half 152.

To guarantee that fresh air can constantly be added through the gap 156 so that the noise produced is suppressed, the valve flaps 40 and 42 can be so operated that the second valve flap 42 is always somewhat open so that through this the air from the gap 156 can constantly flow into the second in-flow aperture so long as the blower 36 is working. It is also conceivable that the second in-flow aperture 74 is of slightly larger cross-section than the second valve flap 42 so that this measure also ensures that air can constantly flow through the gap 156 into the interior 26 of the drier. The pressure rise in the interior 26 of the drier 10 which is brought about with the supply of a proportion of fresh air through the gap 156 can then be dissipated by the open position assumed by the first valve flap 40 more closely to its closed position 75 in that the correspondingly supplied proportion is isolated by being separated from the proportion of recycled air returned via the first in-flow aperture 70, by the action of the blower, the returned portion of recycled air being passed to the waste air orifice 62. In this way, it is possible constantly to achieve a negative pressure in the drier.

The foregoing description and the drawings are limited only to an indication of features which are essential to exemplifying the nature of the invention. Therefore, if features in the description and in the drawings are disclosed and are not mentioned in the Claims, then if required they also serve to define the object of the invention.

I claim:

1. A drier (10) with a control system with valve flaps (40, 42, 44) for controlling the quantities of supply, waste and circulating air transported by a blower (36) for the drying process in a drier drum (16), characterised in that the control system comprises a cohesive valve space (38) which is subdivided by a partition (48) into a first and a second parallel valve space, at least the first partial valve space comprising valve chamber (50) which is substantially closed in respect of the environment and which has at least one blow-in aperture (54) connected to the outlet (56) of the blower (36), which is connected by its induction side (58) to the drum interior and which has at least one waste air orifice (62) which connects the first partial valve space (38) to the outside environment, the second partial valve space comprises at least one inlet aperture (80) which connects the interior of the drum to the outside environment, at least for opening and closing the inlet aperture (80) and blow-in aperture (54), at least one first and one second valve flap (40, 42) are provided and can be moved by at least one triggerable drive into at least one open position and one closed position, in one of its open positions, the first valve flap (40) opens up at least the flow path from the blow-in aperture (54) to the drum interior or, in its closed position, to the waste air orifice (62), while the second valve flap (42), in one of its open positions, opens up the flow path from the outside environment through the inlet aperture (80) to the drum interior, or alternatively and when in its closed position closes this path again and a heat exchanger (34) is disposed at least between the inlet aperture (80) and the drum interior.

2. A drier according to claim 1, characterised in that the first valve chamber (50), with its sides which are towards the environment and which are remote from the partition (48), is closed except for the blow-in aperture (54) and waste air orifice (62) which are provided in it.

3. A drier according to claim 2, characterised in that the first valve flap (40) with its open position diminishing as far as its closed position (75), divides off an increasing proportion of the flow quantity which can be blown through the blow-in aperture by the blower (36), so that it emerges from the waste air orifice (62).

4. A drier according to claim 3, characterised in that in each of its positions, the first valve flap (40) exposes an aperture (76) in the partition (48) which connects the drum interior via the first chamber (50) and the intake aperture (80) of the second valve chamber (52) to the environment when the second valve flap (42) is in one of its open positions.

5. A drier according to claim 4, characterised in that the heat exchanger (34) is disposed over the entire periphery of the in-flow apertures (70, 74) which can be opened up by the first and second valve flap (40, 42) in one of their open positions, towards the drum interior.

6. A drier according to claim 5, characterised in that the drive moves the two valve flaps (40, 42) in opposite directions during their pivoting movements when opening and closing.

7. A drier according to claim 6, characterised in that the drive jointly actuates the first and the second valve flaps (40, 42).

8. A drier according to claim 7, characterised in that for opening and closing the waste air orifice (62), a third valve flap (44) is provided which can be triggered by a drive.

9. A drier according to claim 8, characterised in that in the closed or open position of the third valve flap (44), this latter respectively opens or closes an outlet orifice (126) which, for blowing the washing out of the drum (16) after the drying process, is constantly connected by at least one duct (32) to the end face of the drying drum which is open towards the loading side.

10. A drier according to claim 9, characterised in that the outlet orifice (126) is provided in the partition (48).

11. A drier according to claim 10, characterised in that for blowing out the garments after drying, the side of the heat exchanger (34) which is towards the drum interior can be closed.

12. A drier according to claim 11, characterised in that the second partial valve space is a second valve chamber (52) which corresponds substantially to the first valve chamber (50) and which forms a part of the duct serving for blowing out the washing and which, regardless of the valve position of the second valve flap (42), is closed off in respect of the environment by a shut-off member (140) which is rigidly connected to this valve flap (42).

13. A drier according to claim 12, characterised in that for sound and heat insulation the blower (36), the two valve chambers (50, 52) and the heat exchanger (34) are enclosed by a housing (150) which has a constant aperture which connects the interior of the drum to the environment.

14. A drier according to claim 13, characterised in that the housing (150) consists of two superposed housing halves (152, 154), the lower of the two housing halves (154) substantially accommodates the heat exchanger (34), the upper of the two housing halves (152) is shaped like a hood which is fitted onto the two valve chambers (50, 52) and the blower (36), and in that the two housing halves (152, 154) define by their mutually facing and adjacent sides an encircling gap (156) in order to form the constant aperture.

15. A drier according to claim 14, characterised in that the second valve flap (42), also when in its closed position, partially opens the flow path from the environment into the drum interior through an aperture.

16. A drier according to claim 15, characterised in that at least one of the two valve flaps (40, 42), preferably the first valve flap (40) is so disposed that in each of the flap positions which it can assume, at least a part of its total surface (160, 162) is substantially parallel with the direction of incident flow.

17. A drier according to claim 16, characterised in that at least the first and the second valve flap (40, 42) are so disposed that in the direction of incident flow these valve flaps (40, 42), in each flap position which they are capable of assuming, are opposite the flow and offer only a minimal effective area of resistance of their total surface (160, 162), preferably their end faces (164, 166) which are towards the direction of incident flow.

18. A drier according to claim 16, characterised in that at least a first valve flap (40) is constructed like an aircraft wing, in particular one which has an upwardly extending curvature.

19. A dryer, comprising:

a control system with at least first and second valve flaps for controlling quantities of supply, waste and circulating air for a drying process in a drying drum;

a cohesive valve chamber partitioned by a partition wall into first and second partial valve chambers, and at least the first partial valve chamber being formed of an essentially closed valve chamber which is essentially closed to the surrounding environment, the closed valve chamber having at least one blow-in aperture connected to an outlet of a blower, the blower being connected through an induction side thereof with an interior of the drying drum, the closed valve chamber including at least one waste air orifice connecting the valve chamber with the surrounding environment;

the first partial valve chamber having at least one inlet aperture connecting the surrounding atmosphere with the interior of the drying drum;

the second partial valve chamber having at least one inlet aperture connecting the surrounding atmosphere with the interior of the drying drum;

the first valve flap and the second valve flap being operable for opening and closing of the inlet aperture of the second partial valve chamber and blow-in aperture, respectively;

at least one controllable drive means for moving the first and second valve flaps, respectively, at least into an open setting and a closed setting, the second valve flap in one of its open settings freeing a flow path from the surrounding atmosphere through the inlet aperture of the second partial valve chamber to the interior of the drying drum and in its closed setting closing this path again;

a heating device arranged at least between the inlet aperture and the interior of the drying drum;

the first valve flap opening and closing a first in-flow aperture of the valve chamber connecting the interior of the drying drum with the blow-in aperture such that the flow path provided thereby to the interior of the drum can be freed or respectively can be barricaded; and the first valve flap being positionable in an optional opening setting at least partially barricading the flow path from the blow-in aperture to the waste air orifice and in its closed setting completely freeing that path.

* * * * *